US007039354B2

(12) United States Patent
Miyake

(10) Patent No.: US 7,039,354 B2
(45) Date of Patent: May 2, 2006

(54) PRINTER INCLUDING RECOVER PRINTING CONTROL UNIT

(75) Inventor: Hideyuki Miyake, Hyogo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/732,256

(22) Filed: Dec. 11, 2003

(65) Prior Publication Data

US 2004/0126166 A1 Jul. 1, 2004

(30) Foreign Application Priority Data

Dec. 25, 2002 (JP) ..... 2002-374560

(51) Int. Cl.
*G03G 15/00* (2006.01)

(52) U.S. Cl. ..... 399/390; 399/388

(58) Field of Classification Search ..... 399/390, 399/388, 384, 382, 381, 361; 400/708, 703
See application file for complete search history.

(56) References Cited

U.S. PATENT DOCUMENTS 3,961,781 A * 6/1976 Funk ..... 493/13
4,275,293 A * 6/1981 Chambors ..... 250/223 R
4,317,629 A * 3/1982 Kuseski ..... 355/24
4,338,023 A * 7/1982 McGibbon ..... 399/19
4,786,041 A * 11/1988 Acquaviva et al. ..... 271/3.13
5,105,363 A * 4/1992 Dragon et al. ..... 700/225
5,219,234 A * 6/1993 Sakai ..... 400/120.16
5,335,837 A * 8/1994 Saeki et al. ..... 226/110
5,936,655 A * 8/1999 Biedermann ..... 347/218

FOREIGN PATENT DOCUMENTS

JP A 61-266285 11/1986

* cited by examiner

*Primary Examiner*—Anthony H. Nguyen
(74) *Attorney, Agent, or Firm*—Oliff & Berridge, PLC

(57) ABSTRACT

A printer includes a transport path, a processing unit, a plurality of transport abnormality detection, a transport page state judgment unit, and a recovery printing control unit. A paper is continuously transported along the transport path. The transport path is divided into a plurality of transport sections in the middle of the processing unit. The transport abnormality detection units detect transport abnormality of the paper in the transport sections, respectively. The transport page state judgment unit judges state of the paper in each of transport sections. When one of the transport abnormality detection units detects the transport abnormality of the paper in one of the transport sections, the recovery printing control unit sets content of a transported page of the paper present in the one of the transport sections and content of a page following to the transported page as contents to be printed thereafter, and resumes printing.

4 Claims, 6 Drawing Sheets

FIG. 3

| TRANSPORTED PAGE | STACK COMPLETION | FIXING COMPLETION | TRANSFER COMPLETION |
|---|---|---|---|
| | PAGE 10 | PAGE 12 | PAGE 14 |
| PAPER FEED JAM | 1 | 1 | 1 |
| INTERMEDIATE JAM | 1 | 1 | 0 |
| PAPER DISCHARGE JAM | 1 | 0 | 0 |

PRINTER INCLUDING RECOVER PRINTING CONTROL UNIT

The present disclosure relates to the subject matter contained in Japanese Patent Application No. 2002-374560 filed on Dec. 25, 2002, which is incorporated herein by reference in its entirety.

BACKGROUND OF THE INVENTION

1. Field of the Invention

The present invention relates to a printer for performing printing, for example, by transferring and fixing toner onto a continuous sheet of paper while transporting the continuous sheet of paper.

2. Description of the Related Art

As a related-art printer, there is an electrophotographic printer in which before printing of a certain page is completed, a sheet of paper for a page next to the certain page can be taken in so that printing of the next page can be started. In this type printer, when a jam (paper jam) is detected at the time of execution of the printing process for a plurality of pages before and after a certain page, contents of the pages which are under the printing process at the point of time of detection of the jam are recorded so that recorded contents of the pages can be printed after the jam is eliminated. According to this technique, after pages which are present in the printer at the point of time of detection of the jam and which are just after transferring of toner and in the middle of fixing of toner are invalidated, contents of these pages can be reprinted newly (JP-A-61-266285).

For example, in a printer of the type in which a continuous sheet of paper is transported along a relatively long transport path, even a page which has just passed through a transfer portion having no relation to a jam at a point of time of detection of the jam or even a page which is passing through a fixing portion at a point of time of detection of the jam can be used as a valid page without any problem in a print result because toner can be fixed completely on this page if this page is passed through the fixing portion as it is.

In the related-art printer, however, after all pages existing in the printer at the point of time of detection of the jam are invalidated, the contents of the pages are reprinted. Accordingly, part of the pages having no relation to the jam must be printed duplicately and wastefully though they can be used effectively without necessity of reprinting.

Even in the case where duplicate printing is made, it is impossible to specify the range of pages because page numbers for duplicate printing vary according to jamming places if jams are detected in a plurality of places.

SUMMARY OF THE INVENTION

The invention is developed under such circumstances. An object of the invention is to provide a printer in which duplicate printing can be avoided at the time of reprinting in order to eliminate waste as sufficiently as possible and in which duplicate pages due to reprinting can be specified easily.

In order to solve the problem, the embodiment of the invention takes the following technical means.

According to a first aspect of the invention, a printer includes a transport path, a processing unit, a plurality of transport abnormality detection units, a transport page state judgment unit, and a recovery printing control unit. The transport path includes a predetermined paper feed start position and a predetermined paper discharge completion position. A paper is continuously transported along the transport path. The processing unit performs a predetermined process on the paper. The transport path is divided into a plurality of transport sections in the middle of the processing unit. The transport abnormality detection units detect transport abnormality of the paper in the transport sections, respectively. The transport page state judgment unit judges state of the paper in each of transport sections. When one of the transport abnormality detection units detects the transport abnormality of the paper in one of the transport sections, the recovery printing control unit sets content of a transported page of the paper present in the one of the transport sections and content of a page following to the transported page as contents to be printed thereafter, and resumes printing.

According to a second aspect of the invention, when the one of the transport abnormality detection units detects the transport abnormality of the paper in the one of the transport sections, the recovery printing control unit further sets content of a transported page present in another transport section on a discharge side of the one of the transport sections as content to be printed in a reduced size.

According to a third aspect of the invention, a printer includes a transport path, a processing unit, a plurality of transport abnormality detection units, a transport page state judgment unit, and a recovery printing control unit. The transport path includes a predetermined paper feed start position and a predetermined paper discharge completion position. A paper is continuously transported along the transport path. The processing unit performs a predetermined process on the paper. The transport path is divided into a plurality of transport sections in the middle of the processing unit. The transport abnormality detection units detect transport abnormality of the paper in the transport sections, respectively. The transport page state judgment unit judges state of the paper in each of transport sections. When one of the transport abnormality detection units detects the transport abnormality of the paper in one of the transport sections, the recovery printing control unit sets contents of transported pages of the paper present in all of the transport sections and content of a page following to the transported pages as contents to be printed on a first part of the paper thereafter; and a message as content to be printed on a second part of the paper thereafter, the message indicating that the transported page present in a transport section on a discharge side of the one of the transport sections is printed doubly, and the recovery print control unit resumes printing.

An embodiment of the invention may be configured as follows. The process unit includes a transferring unit for transferring a printed material on the paper; and a fixing unit for fixing the printed material on the paper. The transport sections include a paper feed section from the predetermined paper feed start position to the transferring unit; an intermediate section from the transferring unit to the fixing unit; and a paper discharge section from the fixing unit to the predetermined paper discharge completion position. The intermediate section includes the paper for at least single page on which the transferring unit has completely finished to transfer the printed material. The paper discharge section includes the paper for at least single page on which the fixing unit has completely finished to fix the printed material.

According to the first aspect of the invention, at the time of reprinting after detection of transport abnormality, the transported page present in the transport section with the abnormality transport and pages following the transported page are reprinted. Accordingly, at least one transported page present in any other transport section on the paper discharge side of the transport section with the transport abnormality is prevented from being reprinted as a valid page. Hence, duplicate printing can be avoided at the time of reprinting so that waste caused by duplicate printing can be eliminated as sufficiently as possible.

According to the second aspect of the invention, at the time of reprinting after detection of transport abnormality, the transported page present in the transport section with the transport abnormality and pages following the transported page are reprinted while contents of at least one transported page present in any other transport section on the paper discharge side of the transport section with the transport abnormality is subjected to reduction printing. Accordingly, it is possible to easily find out the duplicate page at a glance, though the page subjected to reduction printing is a duplicate of a page validated without necessity of reprinting, in terms of contents.

According to the third aspect of the invention, at the time of reprinting after detection of transport abnormality, the contents of transported pages present in all the transport sections inclusive of the transport section with the transport abnormality are reprinted while a note indicating duplicate printing of at least one transported page present in any other transport section on the paper discharge side of the transport section with the transport abnormality is printed on another page. Accordingly, it is possible to easily find out the duplicate page from the contents of the note printed on the other page, though part of the pages validated without necessity of reprinting may be duplicated.

For example, the transport path is divided into three sections, that is, the paper feed section, the intermediate section and the paper discharge section. When transport abnormality is detected in the first section (paper feed section) in the condition that printing is performed while a sheet of paper is transported along the transport path, transported pages present in the intermediate section and the paper discharge section which are normal in transport state at the point of time of detection of the transport abnormality can be used effectively if the transported pages are transported and discharged as they are. Accordingly, waste caused by at least two pages' duplication can be avoided. On the other hand, when transport abnormality is detected in the intermediate section, at least one transported page present in the paper discharge section on the paper discharge side of the intermediate section with the transport abnormality can be used effectively if the transported page is transported and discharged as it is. Accordingly, waste caused by at least one page's duplication can be avoided.

Other features and advantages of the invention will become more apparent from the following detailed description with reference to the drawings.

BRIEF DESCRIPTION OF THE DRAWINGS

FIG. 3 is an explanatory view for explaining a data table used for recovery printing.

DETAILED DESCRIPTION OF THE PREFERRED EMBODIMENT

Preferred embodiments of the invention will be described below specifically with reference to the drawings.

Figure 1:
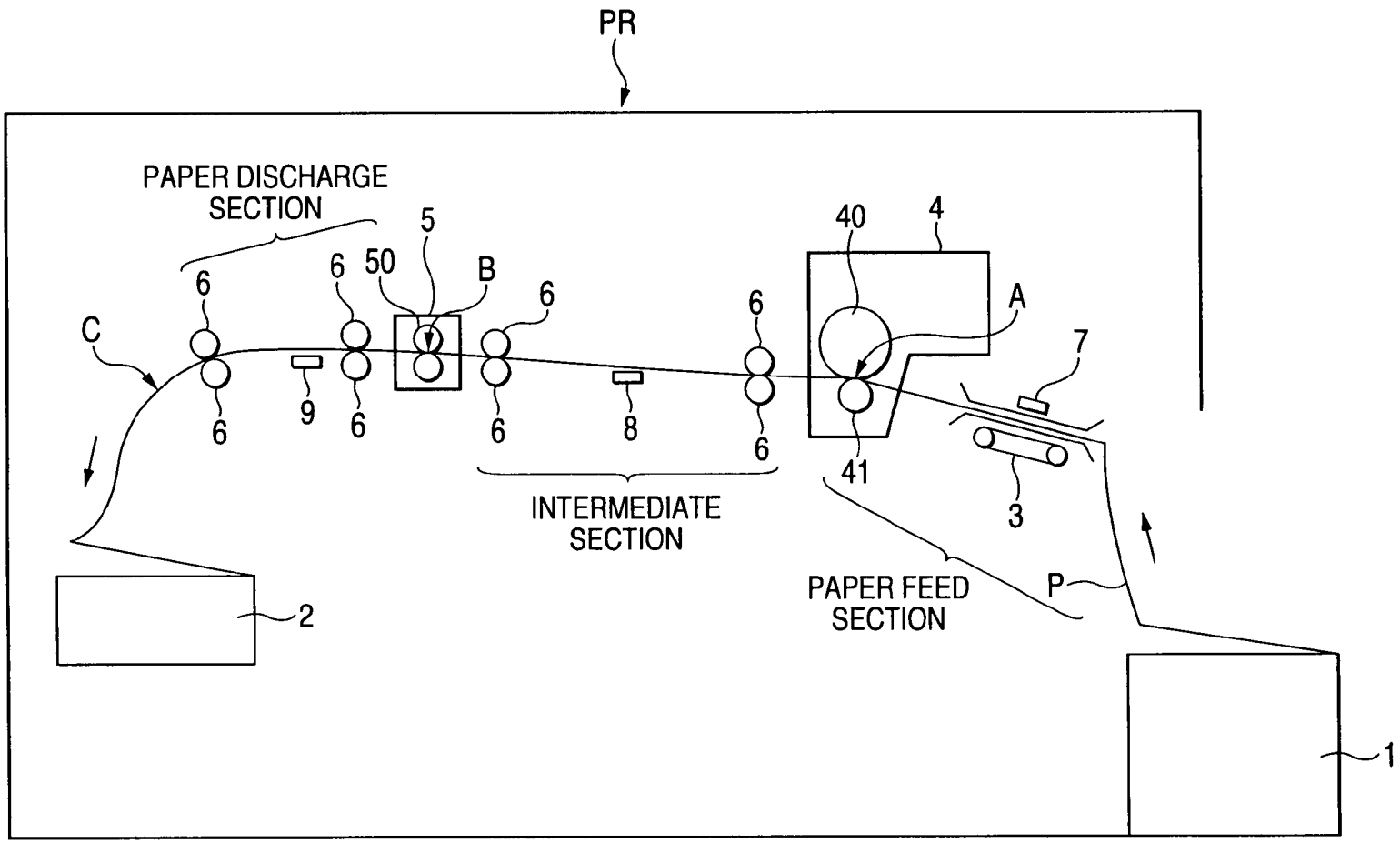
FIG. 1 is a schematic view showing a basic configuration of a printer according to an embodiment of the invention.

FIG. 1 is a schematic diagram showing a basic configuration of a printer according to an embodiment of the invention. A printer PR performs printing on a continuous sheet of paper P by electrophotography while transporting the continuous sheet of paper P along a transport path between a paper hopper portion 1 and a paper stacker portion 2. The printer PR includes a tractor transport mechanism 3, a transfer portion 4, a fixing portion 5, transport rollers 6, and jam sensors 7 to 9. The constituent members 1 to 9 are provided at respective places on the transport path. The continuous sheet of paper P has lines of perforations formed at regular intervals in the transport direction. The continuous sheet of paper P is folded zigzaggedly along the lines of perforations in each of the paper hopper portion 1 and the paper stacker portion 2 so that a one-page's print area of paper is formed between every adjacent two lines of perforations. The transport path has a paper feed section formed between a paper feed start position and the transfer portion 4, an intermediate section formed between the transfer portion 4 and the fixing portion 5, and a paper discharge section formed between the fixing portion 5 and a stack completion point (a paper discharge completion position) C which will be described later. The paper feed start position is set between the paper hopper portion 1 and the tractor transport mechanism 3. Incidentally, a paper sensor is provided at the paper feed start position (particularly not shown) so that a front end of the continuous sheet of paper P is detected by the paper sensor at the time of starting transport after the continuous sheet of paper P is set initially.

The tractor transport mechanism 3 transports the continuous sheet of paper P in such a manner that feed holes formed at opposite ends of the continuous sheet of paper P are raked out by tractor pins. A jam sensor designated by the reference numeral 7 is provided in order to detect a paper jam (jam) in the neighborhood (the paper feed section) of the tractor transport mechanism 3. The jam sensor 7 is referred to as a "paper feed jam sensor". The transfer portion 4 transfers toner onto the continuous sheet of paper P by means of a photoconductor drum 40, a transfer roller 41, etc. The fixing portion 5 fixes the toner on the continuous sheet of paper P by passing the continuous sheet of paper P between heat-compression rollers 50 and 50. A jam sensor designated by the reference numeral 8 is provided in order to detect a paper jam (in the intermediate section) between the transfer portion 4 and the fixing portion 5. The jam sensor 8 is referred to as an "intermediate jam sensor". A jam sensor designated by the reference numeral 9 is provided in order to detect a paper jam (in the paper discharge section) between the fixing portion 5 and the stack completion point C. The jam sensor 9 is referred to as a "paper discharge jam sensor". The transport rollers 6 transport the continuous sheet of paper P while applying tension to the continuous sheet of paper P to some extent.

Figure 2:
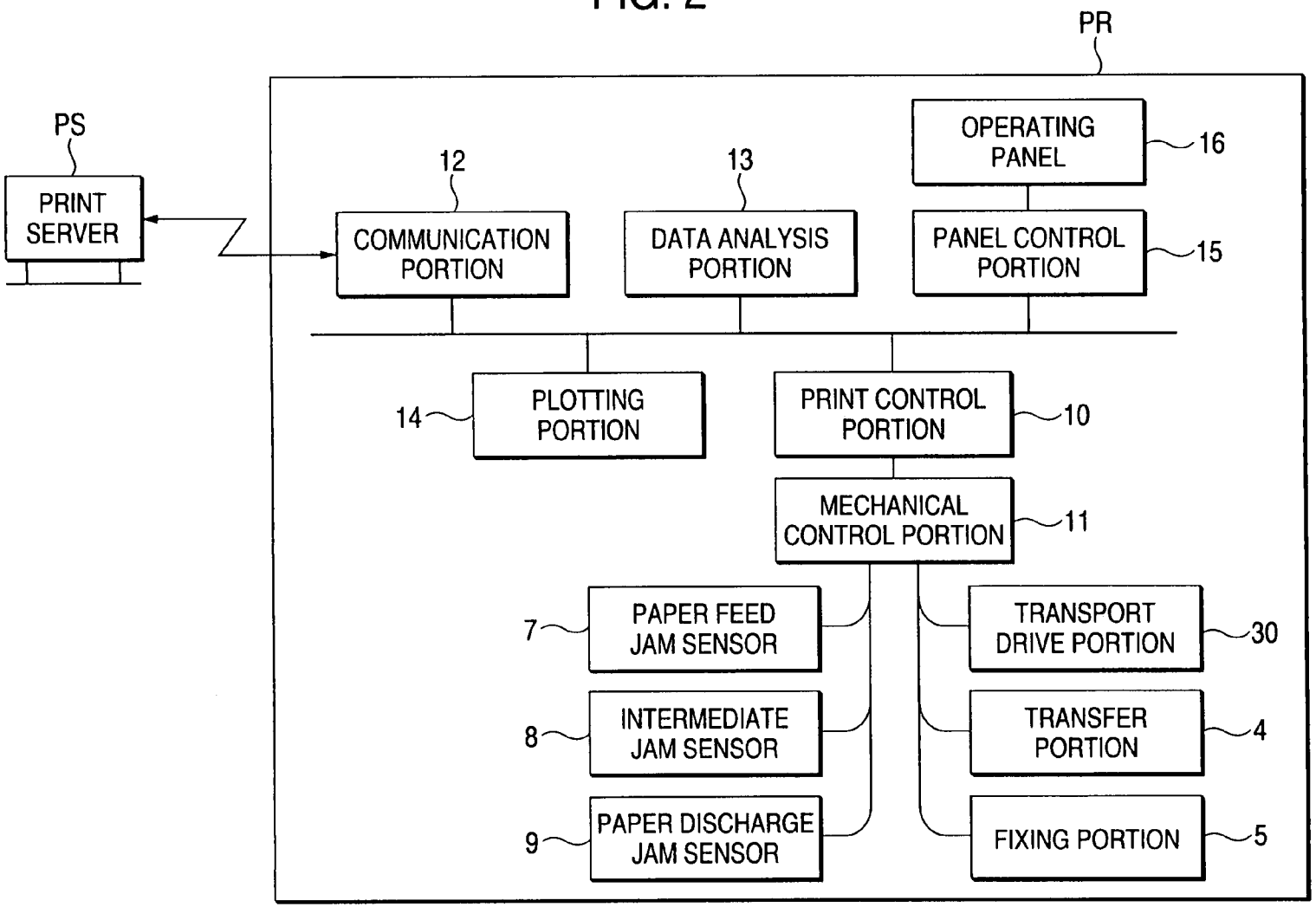
FIG. 2 is a block diagram showing an electrical configuration of the printer.

FIG. 2 is a block diagram showing an electrical configuration of the printer PR. The printer PR has a built-in microcomputer. The microcomputer functions as a print control portion 10, a mechanical control portion 11, a communication portion 12, a data analysis portion 13, a plotting portion 14, and a panel control portion 15. The transfer portion 4, the fixing portion 5, the jam sensors 7 to 9 and a transport drive portion 30 for driving the tractor transport mechanism 3 and the transport rollers 6 are connected to the mechanical control portion 11. An operating panel 16 is connected to the panel control portion 15.

The print control portion 10 controls the operation of the printer as a whole. The mechanical control portion 11 exchanges various signals with the print control portion 10, the transfer portion 4, the fixing portion 5, the jam sensors 7 to 9 and the transport drive portion 30. The communication portion 12 exchanges print data, commands, and so on with a print server PS connected to the printer PR. The data analysis portion 13 converts the print data received from the print server PS into internal code format type print data page by page. The plotting portion 14 expands the internal code format type print data generated by the data analysis portion 13 into bit map data. The bit map data are sent to the mechanism control portion 11 via the print control portion 10. The mechanism control portion 11 controls the operations of the transfer portion 4 and the transport drive portion 30 on the basis of the bit map data. Accordingly, toner images corresponding to the print data are page by page transferred onto the continuous sheet of paper P by the transfer portion 4. The panel control portion 15 exchanges various signals between the operating panel 16 and the print control portion 10. Though not shown particularly, a display screen capable of displaying various kinds of information, operating keys, a buzzer, and so on are provided in the operating panel 16.

More specifically, as the continuous paper P is transported, the print control portion 10 cumulatively calculates a transported length of the continuous sheet of paper P, that is, a distance by which the continuous sheet of paper P is transported after the front end of the continuous sheet of paper P is detected by the paper sensor located in the paper feed start position. The print control portion 10 recognizes the one-page's length of the continuous sheet of paper P set in the printer, on the basis of print setting information received together with the print data from the print server PS. The print control portion 10 ascertains the states of transported pages sequentially as to which page is present in each of the paper feed section, the intermediate section and the paper discharge section, on the basis of the transported distance and one-page's length of the continuous sheet of page P. This ascertainment can be achieved in the following manner. That is, distance data for indicating distances by which the continuous sheet of paper P must be transported from the paper feed start position to arrive at a transfer completion point designated by the sign A, a fixing completion point designated by the sign B, and a stack completion point designated by the sign C in FIG. 1 are installed in a control program in advance. The control portion 10 makes a judgment on the basis of such distance data with reference to the virtual points A to C as to which page is present in each section.

When a jam is detected in any one of the sections at the time of printing, the print control portion 10 ascertains pages existing in all the sections inclusive of the section where the jam occurred (transport abnormality section), and performs recovery printing after the jam is eliminated.

FIG. 3 is an explanatory view for explaining a data table used for recovery printing. In the data table, flags "0" and "1" represent a page from which printing should be resumed (recovered) for each section where the jam is detected. The flag "0" corresponds to a new top page at the time of resumption of printing. On the other hand, the flag "1" corresponds to a page which can be used without any problem after processing in the fixing portion 5 when the continuous sheet of paper P is transported as it is after elimination of the jam. For this reason, pages which have been already transported before the page corresponding to the flag "1" are not reprinted in the recovery printing. The page, which has incompletely passed through the transfer portion 4, is, however, necessarily flagged to "0" so that this page can be reprinted because temporary suspension in transferring will cause disorder of the toner image if this page is transported as it is and passed through the fixing portion 5. On the other hand, the page, which has completely passed through the stack completion point C, is necessarily flagged to "1" so that this page cannot be reprinted because both transferring and fixing have been already completed for this page.

A page which has been stacked, a page onto which toner has been fixed and a page onto which toner has been transferred at the time of detection of the jam are written in "transported page" columns respectively. Incidentally, the page which has been stacked, the page onto which toner has been fixed, the page onto which toner has been transferred mean pages, which the print control portion 10 decides as the latest pages which have completely passed through the stack completion point C, the fixing completion point B and the transfer completion point A, respectively. When, for example, the page which has been stacked is page 10, pages 1 to 10 are regarded as having already completely passed through the stack completion point C. When, for example, the page onto which toner has been transferred is page 12, pages 11 and 12 are regarded as having already completely passed through the fixing completion point B. When, for example, the page on which toner is transferred is page 14, pages 13 and 14 are regarded as having already completely passed through the transfer completion point A. Even in the case where the continuous sheet of paper P is being transported normally without detection of any jam, the latest pages which have completely passed through the points A to C respectively are written in the "transported page" columns respectively. Transported pages are decided at a point of time when a jam is detected. The print control portion 10 refers to the data table generated in this manner, at the time of recovery printing. Furthermore, the contents of the data table are sent to the print server PS before recovery printing.

Next, the operation of the printer at the time of recovery printing will be described.

Figure 4:
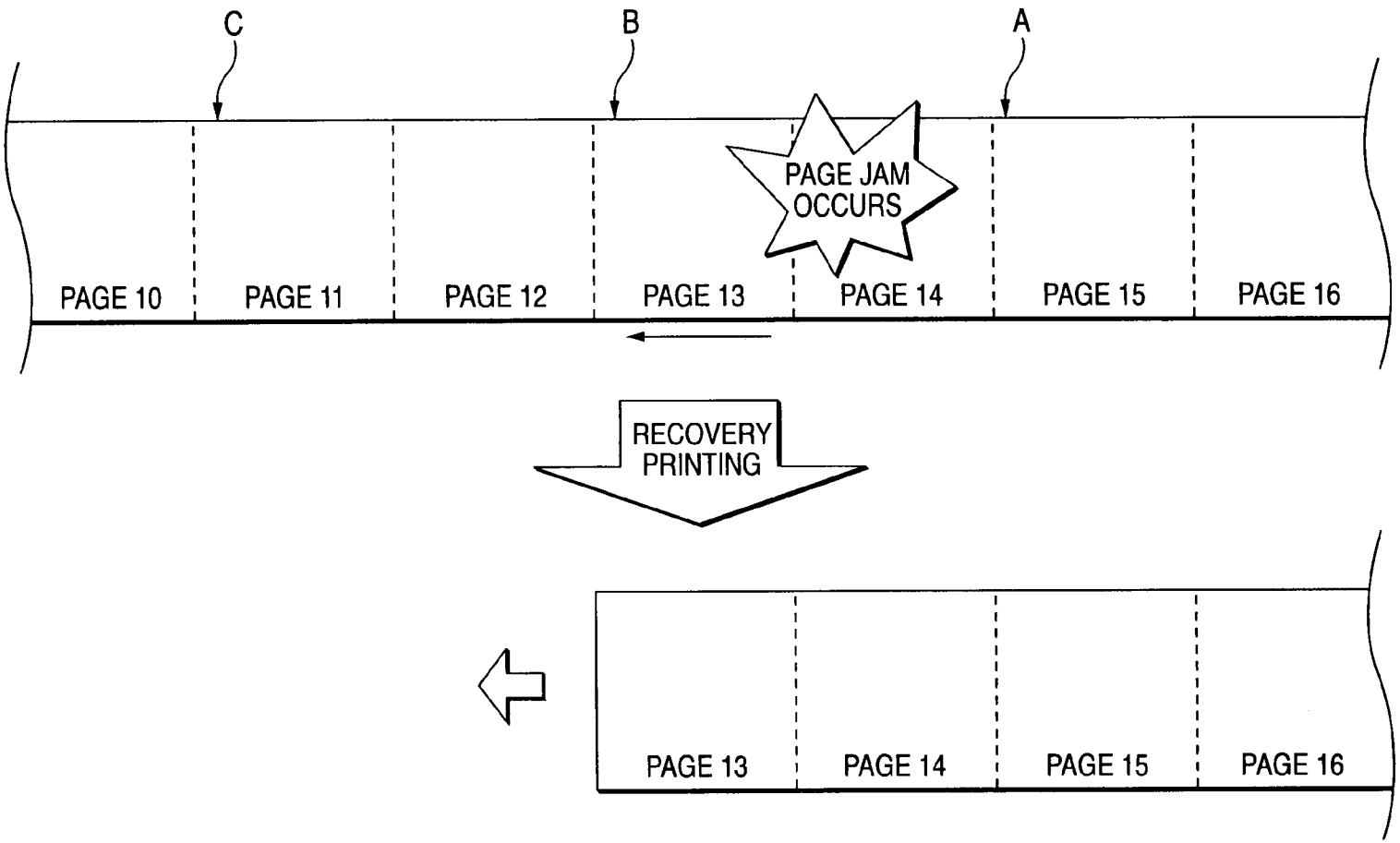
FIG. 4 is an explanatory view for explaining an operation of the printer at the time of recovery printing.

FIG. 4 is an explanatory view for explaining the operation of the printer at the time of recovery printing. When, for example, a jam is detected between the transfer completion point A and the fixing completion point B, that is, in the intermediate section by the intermediate jam sensor 8, as shown in FIG. 4, the contents of the data table at this point of time are generated as shown in FIG. 3.

According to the data table shown in FIG. 3, when the jam is detected in the intermediate section, page 10 which has been stacked is flagged to "1". Accordingly, print contents of pages 1 to 10 are treated as print contents which do not have to be reprinted at the time of recovery printing. Page 12 onto which toner has been fixed is also flagged to "1". Accordingly, print contents of pages 11 and 12 inclusive of page 11 being passing through the stack completion point C are treated as print contents which do not have to be reprinted at the time of recovery printing.

On the other hand, page 14 onto which toner has been transferred is flagged to "0" because this page is present in the transport abnormality section. Accordingly, print contents of pages 13, 14, 15, . . . are treated as print contents which have to be reprinted at the time of recovery printing. Specifically, a command for requesting re-transmission of print data of pages 13, 14, 15, . . . is sent to the printer sever PS at the time of reprinting. Print data of pages 13, 14, 15, . . . are sent from the print server PS to the printer successively in accordance with the command, so that reprinting is done. Incidentally, when print data of any page which has to be reprinted remain in a buffer memory or the like at the point of time of detection of the jam, the print data may be read from the buffer memory or the like so as to be used for reprinting.

Jam information is transmitted from the control print portion 10 to the panel control portion 15. A notice indicating the fact that the transport abnormality section is the intermediate section and a notice indicating the fact that recovery printing will start from page 13, as well as a message indicating a transport error, are displayed on a display screen of the operating panel 16 and a buzzer for alarming the transport error is also sounded on the basis of the jam information. The jam information is also transmitted to the print server PS, so that the same contents as described above are displayed on a display screen of the print server PS.

Then, a user eliminates the jam by removing jammed paper from a place where the jamming occurs and sets a front end of the continuous sheet of paper P in the tractor transport mechanism 3 again at an initial print ready stage. On this occasion, for example, the continuous sheet of paper P is cut between pages 12 and 13, and pages 13 to 15 corresponding to the pages onto which toner has been completely transferred (or partially transferred) and the pages causing the paper jam are further removed. Since page 16 has not been subjected to any process yet, this page can be used as a new top page at the time of recovery printing. Of course, if page 15 or 17 has not been bent yet and has no toner image transferred, this page 15 or 17 may be used as a new top page at the time of recovery printing.

When a necessary operation is then performed, a process after elimination of the jam is carried out so that pages up to page 12 remaining in the printer are automatically transported as they are and fed to the paper stacker portion 2 via the stack completion point C. Since the pages up to page 12 are not present in the transport abnormality section (in the intermediate section in the embodiment) and fixing on the pages up to page 12 is completed, the pages up to page 12 are treated as pages, which are allowed to be discharged as they are without any problem.

When a necessary operation for starting recovery printing is then performed, page 13 at the time of detection of the jam is set as a new top page before recovery printing is started, as shown in the lower part of FIG. 4. That is, the pages up to page 12 are discharged directly as pages without any problem before recovery printing, so that valid pages are not printed duplicately due to the recovery printing.

Incidentally, when a jam is detected in the paper feed section on the paper feed side of the transfer completion point A, recovery printing is performed in the same procedure as the aforementioned procedure while the data table is referred to. Accordingly, page 15 present in the paper feed section as the transport abnormality section is set as a new top page and reprinting is then started. On the other hand, pages up to page 14 can be discharged directly as pages without any problem before recovery printing, so that the pages up to page 14 are not reprinted due to the recovery printing.

Hence, according to this embodiment, at the time of recovery printing after detection of the jam, the transported page present in the transport abnormality section and pages following the transported page are reprinted and the transported pages present in the transport section on the paper discharge side of the transport abnormality section are validated as they are. Accordingly, duplicate printing at the time of reprinting can be avoided without reprinting the pages up to the transported page printed normally, so that waste of expendable supplies such as a continuous sheet of paper P and toner can be eliminated.

Next, another embodiment of the invention will be described. Since this embodiment has the same mechanical structure and electrical configuration as those of the aforementioned embodiment, an operation of the printer at the time of recovery printing will be described with reference to FIG. 5 and in conjunction with FIGS. 1 to 3.

Figure 5:
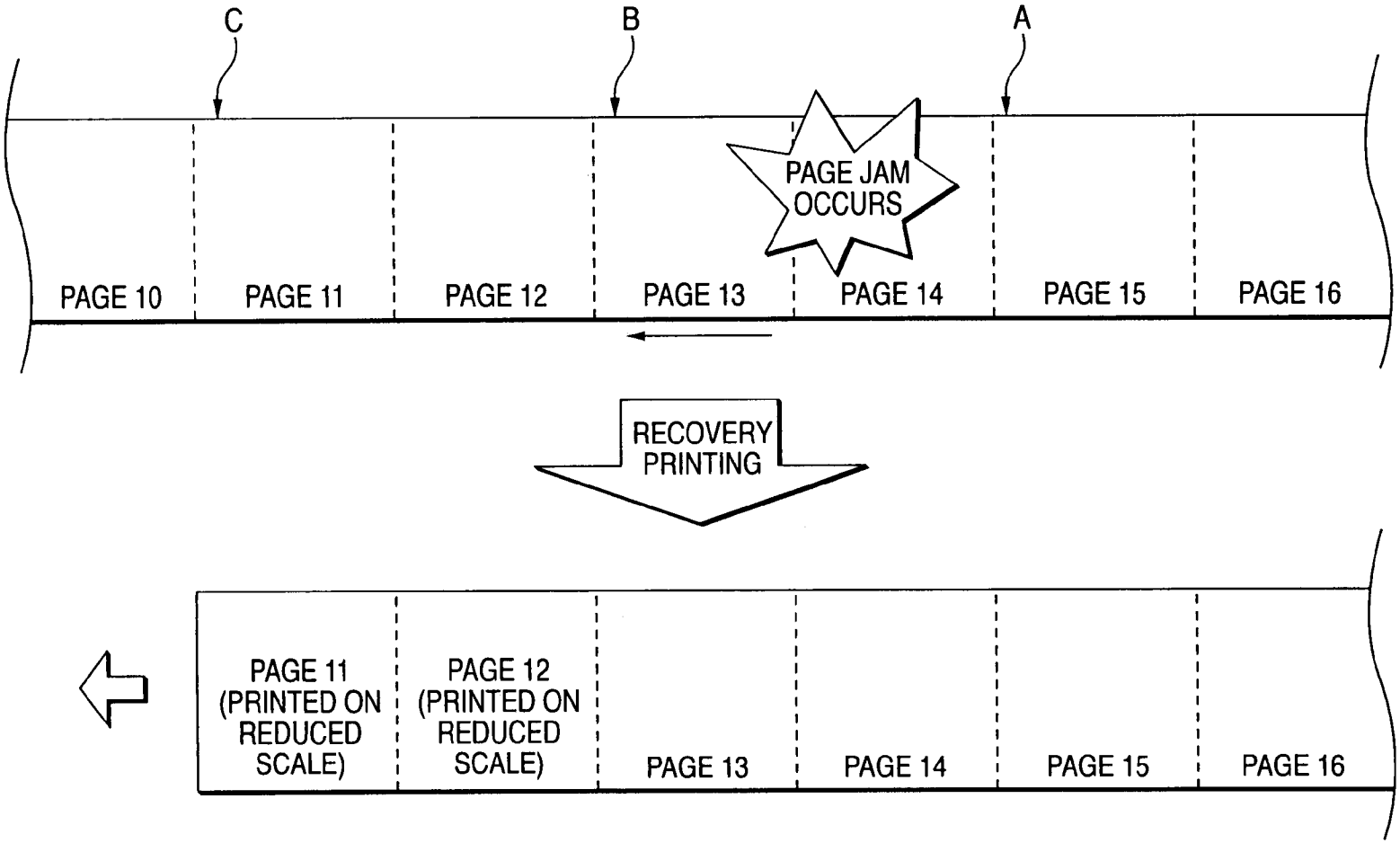
FIG. 5 is an explanatory view for explaining an operation of the printer at the time of recovery printing according to another embodiment of the invention.

FIG. 5 is an explanatory view for explaining an operation of the printer at the time of recovery printing according to this embodiment. Also in this embodiment, as shown in FIG. 5 by way of example, when a jam is detected between the transfer completion point A and the fixing completion point B, that is, in the intermediate section by the intermediate sensor 8, contents of the data table at this point of time are generated as shown in FIG. 3.

When the jam is detected in the intermediate section, page 10 which has been stacked is flagged to "1" so that print contents of pages 1 to 10 are prevented from being reprinted at the time of recovery printing in the same manner as in the aforementioned embodiment. Further, because page 14 onto which toner has been transferred is present in the transport abnormality section, the page 14 is flagged to "0" so that print contents of pages 13, 14, 15, . . . have to be reprinted at the time of recovery printing in the same manner as in the aforementioned embodiment.

On the other hand, since page 12 onto which toner has been fixed is flagged to "1", the page 12 does not have to be reprinted naturally. Print contents of pages 11 and 12 inclusive of page 11 being passing through the stack completion point C are, however, judged to be subjected to reduction printing at the time of recovery printing.

Specifically, at the time of reprinting, a command for requesting scaling down and resending of print data of pages 11 and 12 is sent to the print server PS and then a command for requesting direct resending of print data of pages 13, 14, 15, . . . is sent to the print server PS. The print server PS sends the scaled-down print data of pages 11 and 12 and the original-size print data of pages 13, 14, 15, . . . successively to the printer in accordance with the commands. Thus, reprinting is performed on the basis of these print data. Incidentally, when print data of any page which has to be subjected to reduction printing remains in the buffer memory or the like at the time of detection of the jam, the print data may be reprinted after scaled down by the plotting portion 14 or the like.

Jam information is transmitted from the print control portion 10 to the panel control portion 15. A notice indicating the fact that the transport abnormality section is the intermediate section and a notice indicating the fact that pages 11 and 12 have to be subjected to reduction printing, as well as a message indicating a transport error, are displayed on the display screen of the operating panel 16 and a buzzer for alarming the transport error is also sounded, on the basis of the jam information. Further, the jam information is also transmitted to the print server PS, so that the same contents as described above are displayed on the display screen of the print server PS.

Then, a user eliminates the jam by removing the jammed paper from the jamming place and sets a front end of the continuous sheet of paper P again in the tractor transport mechanism 3 at the initial print ready stage. On this occasion, for example, the continuous sheet of paper P is cut between pages 12 and 13, and pages 13 to 15 corresponding to the pages onto which toner has been completely transferred (or partially transferred) and the pages causing the jam are removed. Since page 16 has not been processed yet, this page can be used as a new top page at the time of recovery printing. Of course, if page 15 or 17 has not been bent yet and has no toner image transferred, the page 15 or 17 may be used as a new top page at the time of recovery printing.

When a necessary operation is then performed, a process after elimination of the jam is carried out so that pages up to page 12 remaining in the printer are automatically transported as they are and fed to the paper stacker portion 2 via the stack completion point C. Since the pages up to page 12 are not present in the transport abnormality section (in the intermediate section in the embodiment) and fixing on these pages is completed, these pages are treated as pages allowed to be discharged as they are without any problem.

When a necessary operation for starting recovery printing is then performed, contents of pages 11 and 12 at the time of detection of the jam are subjected to reduction printing and then contents of page 13 et seq. are reprinted, as shown in the lower part of FIG. 5. That is, the contents of pages 11 and 12 are reprinted while scaled down for confirmation by way of precaution though the pages 11 and 12 have been already discharged as pages allowed to be used effectively.

Incidentally, when a jam is detected in the paper feed section on the paper feed side of the transfer completion point A, recovery printing is performed in the same procedure as described above while the data table is referred to. Accordingly, pages 11 to 14 present in the paper discharge section and the intermediate section on the paper discharge side of the transport abnormality section are subjected to reduction printing and then contents of page 15 et seq. present in the paper feed section as the transport abnormality section are reprinted in their original sizes.

Hence, according to this embodiment, at the time of recovery printing after detection of the jam, the same contents as contents of transported pages which have been already discharged normally because the transported pages were present in the transport section on the paper discharge side of the transport abnormality section are subjected to reduction printing, as well as a transported page present in the transport abnormality section and pages following the transported page are reprinted in their original sizes. Accordingly, it is possible to easily find out duplicate pages at a glance because of reduction printing, though the pages subjected to reduction printing are duplicates of the pages which have been already discharged, in terms of contents.

A further embodiment of the invention will be described below. Since this embodiment has the same mechanical structure and electrical configuration as those of each of the aforementioned embodiments, an operation of the printer at the time of recovery printing will be described with reference to FIG. 6 and in conjunction with FIGS. 1 to 3.

Figure 6:
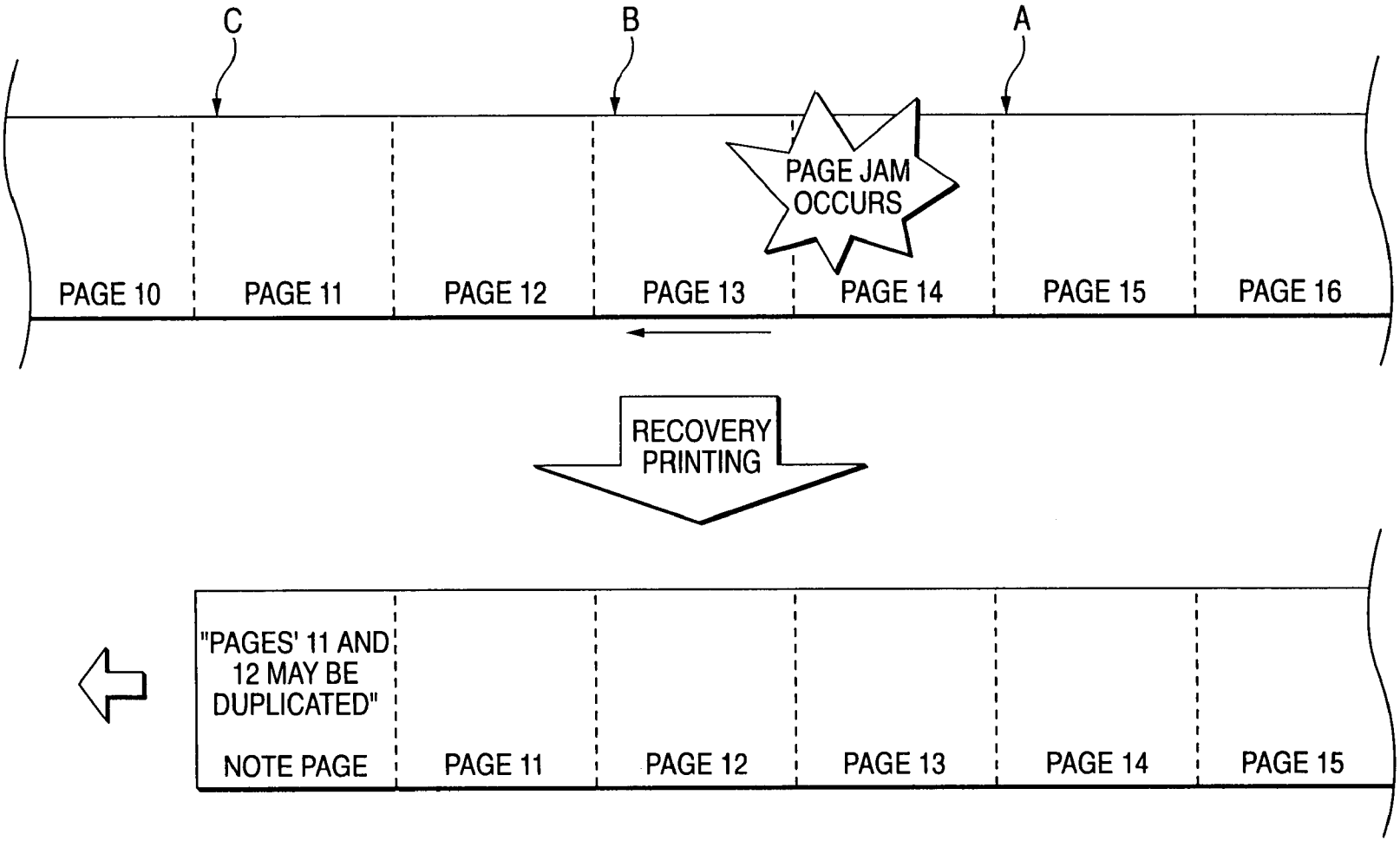
FIG. 6 is an explanatory view for explaining an operation of the printer at the time of recovery printing according to a further embodiment of the invention.

FIG. 6 is an explanatory view for explaining an operation of the printer at the time of recovery printing according to this embodiment. Also in this embodiment, as shown in FIG. 6 by way of example, when a jam is detected between the transfer completion point A and the fixing completion point B, that is, in the intermediate section by the intermediate sensor 8, contents of the data table at this point of time are generated as shown in FIG. 3.

When the jam is detected in the intermediate section, page 10 which has been stacked is flagged to "1" so that print contents of pages 1 to 10 are prevented from being reprinted at the time of recovery printing in the same manner as in the aforementioned embodiments. Further, because page 14 onto which toner has been transferred is present in the transport abnormality section, the page 14 is flagged to "0" so that print contents of pages 13, 14, 15, . . . have to be reprinted at the time of recovery printing in the same manner as in the aforementioned embodiments.

On the other hand, though page 12 onto which toner has been fixed does not have to be reprinted originally because the page 12 is flagged to "1", print contents of pages 11 and 12 inclusive of page 11 being passing through the stack completion point C are regarded to be necessarily reprinted at the time of recovery printing. That is, transported pages present in all the sections except the pages which have passed through the stack completion point C completely are regarded to be necessarily reprinted. Since pages 11 and 12 are discharged before recovery printing so that the pages 11 and 12 are present in the paper stacker portion 2 at the point of time of start of recovery printing, a note page having print contents of a note indicating duplication of pages 11 and 12 is output as a new top page at the time of start of recovery printing.

Specifically, at the time of reprinting, information indicating duplication of pages 11 and 12 is sent to the print server PS and then a command for requesting resending of print data of pages 11, 12, 13, 14, 15, . . . is sent to the print server PS. The print server PS sends the print data of pages 11, 12, 13, 14, 15, . . . successively to the printer in accordance with the information and command. Thus, the note page is printed before reprinting is performed on the basis of these print data.

Jam information is transmitted from the print control portion 10 to the panel control portion 15. A notice indicating the fact that the transport abnormality section is the intermediate section and a notice indicating the fact that pages 11, 12, 13, 14, 15, . . . will be reprinted, as well as a message indicating a transport error and a message indicating the same contents as those of the note page, are displayed on the display screen of the operating panel 16 and a buzzer for alarming the transport error is also sounded on the basis of the jam information. Further, the jam information is also transmitted to the print server PS, so that the same contents as described above are displayed on the display screen of the print server PS.

Then, a user eliminates the jam by removing the jammed paper from the jamming place and sets a front end of the continuous sheet of paper P again in the tractor transport mechanism 3 at the initial print ready stage. On this occasion, for example, the continuous sheet of paper P is cut between pages 12 and 13, and pages 13 to 15 corresponding to the pages onto which toner has been completely transferred (or partially transferred) and the pages causing the paper jam are removed. Since page 16 has not been processed yet, this page can be used as a new top page at the time of recovery printing. Of course, if page 15 or 17 has not been bent yet and has no toner image transferred, the page 15 or 17 may be used as a new top page at the time of recovery printing.

When a necessary operation is then performed, a process after elimination of the jam is carried out so that pages up to page 12 remaining in the printer are automatically transported as they are and fed to the paper stacker portion 2 via the stack completion point C. Since the pages up to page 12 are not present in the transport abnormality section (intermediate section in the embodiment) and fixing on these pages is completed, these pages are treated as pages allowed to be discharged as they are without any problem.

When a necessary operation for starting recovery printing is then performed, a note page having the content "Pages 11 and 12 may be duplicated" is printed first, and contents of page 11 et seq. are then reprinted, as shown in the lower part of FIG. 6. That is, the contents of pages 11 and 12 are reprinted to avoid page missing by way of precaution though the pages 11 and 12 have been already discharged as pages allowed to be used effectively. Furthermore, because there is the possibility that the pages 11 and 12 may be duplicated, printing is performed so that the note page is added to the pages 11 and 12 to make it possible to easily specify the duplicate pages.

Incidentally, when a jam is detected in the paper feed section on the paper feed side of the transfer completion point A, recovery printing is performed in the same procedure as described above while the data table is referred to. Accordingly, a note page having the content "Pages 11 to 14 may be duplicated" is printed before page 11 et seq. in all the sections are reprinted.

Hence, according to this embodiment, at the time of recovery printing after detection of the jam, a note page indicating the possibility of duplicate printing of the transported pages present in the transport sections on the paper discharge side of the transport abnormality section is printed as well as the transported pages present in all the sections inclusive of the transport abnormality section are reprinted. Accordingly, it is possible to easily find out duplicate pages from the contents printed on the note page, though part of the reprinted pages may be duplicated.

Incidentally, the invention is not limited to the aforementioned embodiments.

For example, at the time of recovery printing, one mode may be selected from a mode for avoiding any duplicate page, a mode for applying reduction printing to any duplicate page, and a mode for printing a note page so that an operation can be performed in accordance with the selected mode.

Besides the electrophotographic printer, for example, an inkjet printer or a dot impact printer may be used as the printer PR. The printer PR is not limited to the one for the continuous sheet of paper P. For example, the printer PR may use cut sheets of paper so that printing can be made on a plurality of pages.

The transport path may be preferably divided into at least two sections.

As described above, according to the embodiments of the invention, at the time of reprinting after detection of transport abnormality, a transported page present in the transport section with the abnormality transport and pages following the transported page are reprinted. Accordingly, transported pages present in the transport sections on the paper discharge side of the transport abnormality section are prevented from being reprinted, as valid pages. Hence, duplicate printing at the time of reprinting can be avoided, so that waste caused by duplicate printing can be eliminated as sufficiently as possible.

At the time of reprinting after detection of transport abnormality, a transported page present in the transport section with the transport abnormality and pages following the transported page are reprinted while contents of transported pages present in the transport sections on the paper discharge side of the transport abnormality section are subjected to reduction printing. Accordingly, it is possible to easily find out duplicate pages at a glance, though the pages subjected to reduction printing are duplicates of the pages validated without necessity of reprinting, in terms of contents.

At the time of reprinting after detection of transport abnormality, the contents of transported pages present in all the transport sections inclusive of the transport abnormality section are reprinted while a note indicating the possibility of duplicate printing of transported pages present in the transport sections on the paper discharge side of the transport abnormality section is printed as a separate page. Accordingly, it is possible to easily find out duplicate pages from the contents of the note printed on another page, though part of the pages validated without necessity of reprinting may be duplicated.

What is claimed is:

1. A printer comprising:

a transport path including a predetermined paper feed start position and a predetermined paper discharge completion position, wherein a paper is continuously transported along the transport path;

a processing unit for performing a predetermined process on the paper, wherein the transport path is divided into a plurality of transport sections in the middle of the processing unit;

a plurality of transport abnormality detection units for detecting transport abnormality of the paper in the transport sections, respectively;

a transport page state judgment unit for judging state of the paper in each of transport sections; and a recovery printing control unit, wherein when one of the transport abnormality detection units detects the transport abnormality of the paper in one of the transport sections, the recovery printing control unit sets content of a transported page of the paper present in the one of the transport sections and content of a page following to the transported page as contents to be printed thereafter, and resumes printing from the content of the transported page of the paper, which was present in the one of the transport sections when the one of the transport abnormality detection units detected the transport abnormality of the paper.

2. The printer according to claim 1, wherein when the one of the transport abnormality detection units detects the transport abnormality of the paper in the one of the transport sections, the recovery printing control unit further sets content of a transported page present in another transport section on a discharge side of the one of the transport sections as content to be printed in a reduced size.

3. A printer comprising:

a transport path including a predetermined paper feed start position and a predetermined paper discharge completion position, wherein a paper is continuously transported along the transport path;

a processing unit for performing a predetermined process on the paper, wherein the transport path is divided into a plurality of transport sections in the middle of the processing unit;

a plurality of transport abnormality detection units for detecting transport abnormality of the paper in the transport sections, respectively;

a transport page state judgment unit for judging state of the paper in each of transport sections; and a recovery printing control unit, wherein when one of the transport abnormality detection units detects the transport abnormality of the paper in one of the transport sections, the recovery printing control unit sets:

contents of transported pages of the paper present in all of the transport sections and content of a page following to the transported pages as contents to be printed on a first part of the paper thereafter; and a message as content to be printed on a second part of the paper thereafter, the message indicating that the transported page present in a transport section on a discharge side of the one of the transport sections is printed doubly;

and the recovery print control unit resumes printing.

4. The printer according to claim 1, wherein:

the process unit includes:

a transferring unit for transferring a printed material on the paper; and a fixing unit for fixing the printed material on the paper; the transport sections include:

a paper feed section from the predetermined paper feed start position to the transferring unit;

an intermediate section from the transferring unit to the fixing unit; and a paper discharge section from the fixing unit to the predetermined paper discharge completion position;

the intermediate section includes the paper for at least single page on which the transferring unit has completely finished to transfer the printed material; and the paper discharge section includes the paper for at least single page on which the fixing unit has completely finished to fix the printed material.

* * * * *